US006182869B1

(12) United States Patent
Birky

(10) Patent No.: US 6,182,869 B1
(45) Date of Patent: Feb. 6, 2001

(54) PARTICLE FLOW ENHANCER FOR BULK BIN AUGER SYSTEMS

(76) Inventor: Christian W. Birky, 527 E. State Rte. 8, Kouts, IN (US) 46347

( * ) Notice: Under 35 U.S.C. 154(b), the term of this patent shall be extended for 0 days.

(21) Appl. No.: 09/320,031

(22) Filed: May 26, 1999

Related U.S. Application Data

(60) Provisional application No. 60/087,269, filed on May 29, 1998.

(51) Int. Cl.[7] ..... A45D 24/22
(52) U.S. Cl. ..... 222/196; 222/201; 222/233
(58) Field of Search ..... 222/196, 198, 222/201, 233, 234, 235

(56) References Cited

U.S. PATENT DOCUMENTS 733,628 * 7/1903 Cramer ..... 222/234
2,370,709 * 3/1945 Barton ..... 222/234
3,411,675 * 11/1968 Wahl ..... 222/198
6,062,720 * 5/2000 Ionadi ..... 222/234

* cited by examiner

*Primary Examiner*—Kevin Shaver
*Assistant Examiner*—Thach H Bui
(74) *Attorney, Agent, or Firm*—Bose McKinney & Evans LLP

(57) ABSTRACT

A particle flow enhancer for a bulk bin flex or rigid auger system having a boot and an unloader with a rotating shaft extending through the unloader. The particle flow enhancer including a frame, a drive axle and a striker arm. The frame is attached to the boot of the bulk bin auger system, preferably using some of the same holes used to attach the unloader to the boot. The drive axle is supported by the frame and is driven by the rotating shaft of the bulk bin auger system; the bulk bin auger system providing the power for the particle flow enhancer. The drive axle periodically actuates the striker arm which causes the striker arm to tap the boot of the bulk bin auger system and enhance the flow of particles.

17 Claims, 4 Drawing Sheets

PARTICLE FLOW ENHANCER FOR BULK BIN AUGER SYSTEMS

This appln claims the benefit of U.S. Provisional Ser. No. 60/087,269 filed May 29, 1998.

FIELD OF THE INVENTION

This invention relates to a device that is used to maintain a constant flow of particles through a conveyer system. In particular, the invention relates to a device that maintains the flow of feed, or similar substances, from a bulk storage bin downwardly through an attached boot and unloader for delivery to a flex or rigid auger system that transports the feed to a feed dispenser.

BACKGROUND OF THE INVENTION

Bulk feed systems are routinely used in modern livestock and poultry production. In these operations, feed is a significant input cost and directly affects a producer's bottom line. Producers have begun to grind the feed particles into very small micron sizes to reduce the feed expense. Smaller sized feed particles enable the poultry or livestock to digest the feed better and more effectively utilize it for growth. Thus, the smaller the particle size, the better the feed conversion into pounds of meat, which lowers the cost of the feed input per pound of meat output. However, one drawback with the use of smaller particle sizes is the problem of feed in bulk bin systems becoming "hung up" or packed which reduces or stops the flow of feed. To break up the packed feed and regain flow, the producers have to manually pound on the bin and try to loosen and knock down compacted, finely ground particles into the bin's attached boot and unloader for delivery to the auger system.

Prior devices developed to alleviate this packing problem have many disadvantages. One major disadvantage of many of the prior devices is that they need an additional independent power supply to operate them. The additional power supply increases the purchase price and operating costs of the system, necessitates additional electrical wiring and supplies, and often requires professional installation.

Other disadvantages of prior systems are the size and placement of the units. Many devices on the market today mount on the inside of the bulk bin and totally replace the boot and unloader which the producer already has. This is not only wasteful, but it is very difficult and dangerous to work on systems mounted inside the bulk bin if the system needs to be repaired or replaced.

Another disadvantage of prior methods is the wear and tear on the bulk bin. Many devices either cause a constant vibration on the bin or have spinning chains and rods on the inside of the bin. Both of these methods cause wear not only on the parts in the devices but also on the bin itself. In addition, many of the devices on the market today do not achieve their desired results.

Accordingly, a need exists for a device that does not require a separate power supply; is simple, easy and inexpensive to install, operate and maintain; and does not cause excessive wear on the bulk feed bin. One object of the present invention is to provide such a device.

BRIEF SUMMARY OF THE INVENTION

In accordance with the present invention, a particle flow enhancer is provided for a bulk storage bin having a flex or rigid auger system, having a boot, an unloader, and a rotating shaft extending through the unloader. The particle flow enhancer comprises a drive axle and a striker arm. The drive axle is attached to the bulk bin auger system and is driven by the rotation of the rotating shaft. The striker arm is actuated by the drive axle to periodically strike the boot.

One feature of the present invention is that it comprises a particle flow enhancer that maintains a constant flow of feed and other like substances from the bulk bin into the attached boot and unloader for delivery to a flex or rigid auger system, by providing a constant tapping on the bin's attached boot.

Another feature of the particle flow enhancer of the present invention is that it mounts on the outside of the boot of the bulk bin and can operate off the direct drive of the bin's auger system. This feature has two significant advantages. First, by mounting on the outside of the boot, the device is substantially easier to install, repair, and replace than flow enhancers that are mounted within the interior of the boot or bin. The second significant advantage is that by being driven off the bin's auger system, there is no need for additional drive means, (such as an additional motor) and no need for any additional power sources or wiring (e.g. electrical conduit) for providing power to the drive means. By obviating the need for a separate drive means and power sources, the device can be produced and operated less expensively. The particle flow enhancer provides a simple, mechanical way to automatically cause feed or other substances to flow from the bulk bin into the boot and unloader and be carried out by the auger system regardless to particle micron size.

Preferably, the particle flow enhancer attaches to a bulk bin flex or rigid auger system having a rotating shaft. The particle flow enhancer includes a drive axle attached to the bulk bin auger system which is driven by the rotation of the rotating shaft, and a striker arm that is actuated by the drive axle through a gearing and/or cam system to periodically strike the boot of the bulk bin auger system. The rotating shaft provides the power for the particle flow enhancer to ultimately actuate the striker arm, thereby causing it to strike the boot of the bin auger system. The striking of the boot of the bulk bin auger system by the striker arm enhances the flow of particles through the boot and bulk bin auger system.

DETAILED DESCRIPTION OF THE INVENTION

Figure 1:
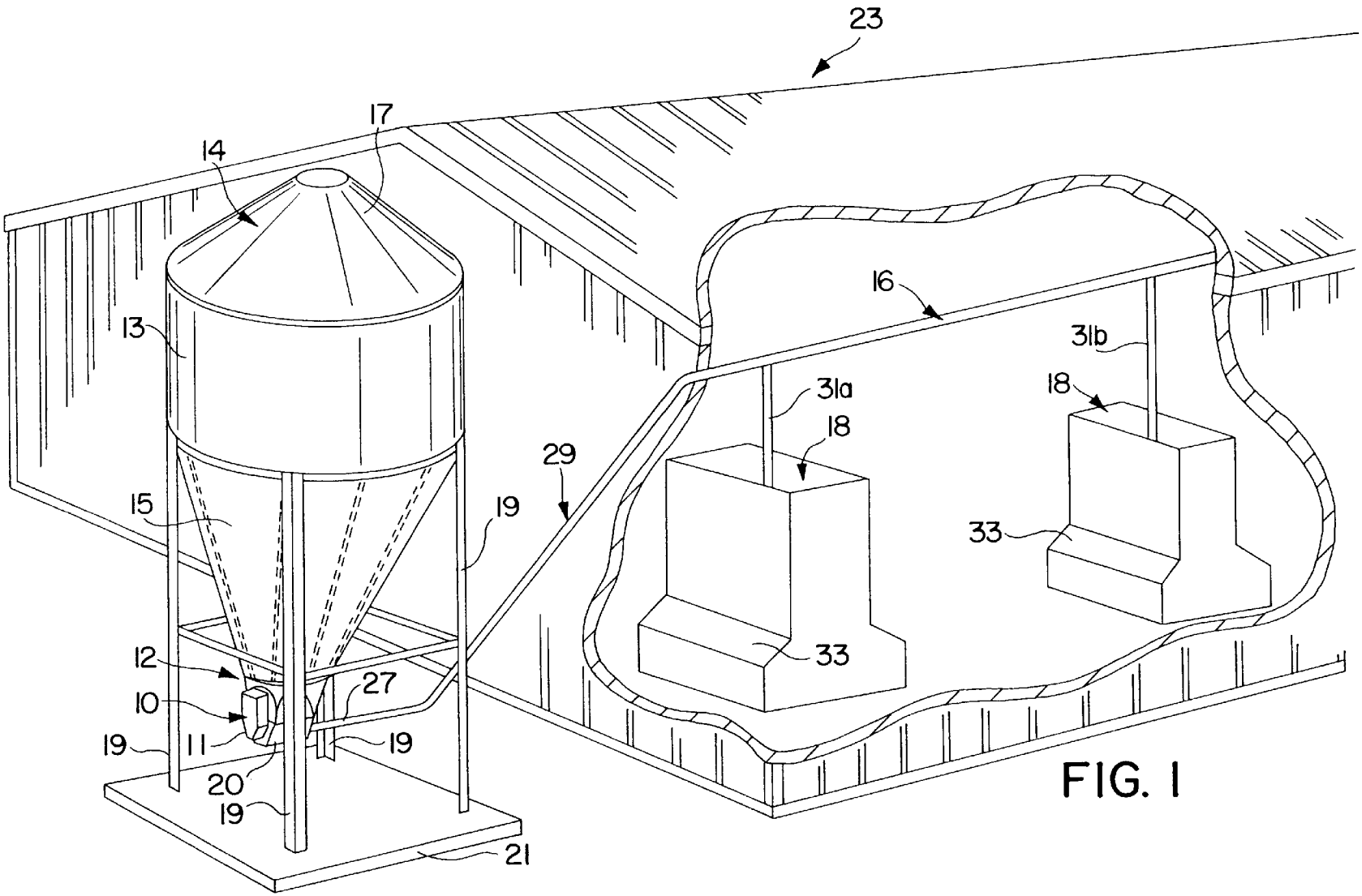
FIG. 1 is a perspective, partly broken away view of a typical livestock/poultry bulk bin auger feed system.

As shown in FIG. 1, a particle flow enhancer 10 mounts on the exterior of a boot 12 of a bulk feed bin 14. The bulk feed bin 14 stores grain that is periodically released to a flex or rigid auger system 16 for distribution to one or more feeders 18 from which livestock eat the feed.

A typical bulk feed bin includes a cylindrical upper portion 13 that is disposed above a generally frusto-conical lower funnel portion 15. A conical roof 17 prevents moisture and rain from entering the interior of the feed bin 14. Legs 19 that are anchored into a concrete pad 21 support the bulk feed bin 14 above the ground. The boot 12 is disposed below the lower funnel portion 15 and includes a downwardly opening aperture, out of which grain stored within the interior of the feed bin 14 can flow under the influence of gravity. The purpose of the bulk feed bin 14 is to store grain that is used to feed livestock housed within livestock barn 23.

The auger system 16 includes an upstream boot unloader 20 having an upwardly opening aperture (not shown) that is matingly positioned in fluid communication with the downwardly opening aperture of the boot 12 of the feed bin 14. The boot unloader 20 is coupled to the upstream end 27 of the feed pipe member 29 of the auger system 16. A flexible, rotatable auger (not shown) is disposed within substantially the entire length of the feed pipe member 29. Rotation of the rotatable auger within feed pipe member 29 moves grain longitudinally within the feed pipe member 29 from the boot unloader 20, past the downwardly extending feeder delivery tubes 31*a*, 31*b* to the downstream end (not shown) of the feed pipe member 29. During the passage of the grain through the feed pipe member 29, a portion of the grain falls into the delivery tubes 31*a*, 31*b*, and into feeder 18. The feeder 18 contains food delivery troughs 33, out of which the animals can eat the feed.

The particle flow enhancer 10 in FIG. 1 is shown with a cover 11. The cover 11 can be made of plastic and is designed to cover five of the six sides of the flow enhancer 10, with the sixth side being open. The sixth side is open as the side of the flow enhancer 10 that is attached to the surface of the boot 12 needs no cover. Also, by keeping the sixth side open, the cover 11 can be slid easily over the drive and striker mechanism of the particle flow enhancer 10. This arrangement of cover 11 facilitates installation of the flow enhancer 10, and permits the cover 11 to be removed easily if and when repairs must be made on the internal drive mechanism or striker of the particle flow enhancer 10. Screws (not shown) can be provided for extending through the cover 11 and securing it to the remainder of the particle flow enhancer 10. The cover 11 preferably encloses the sides and front of the particle flow enhancer 10 as shown by the dotted line in FIG. 2 to encase the particle flow enhancer 10 within a weather resistant housing.

Figure 4:
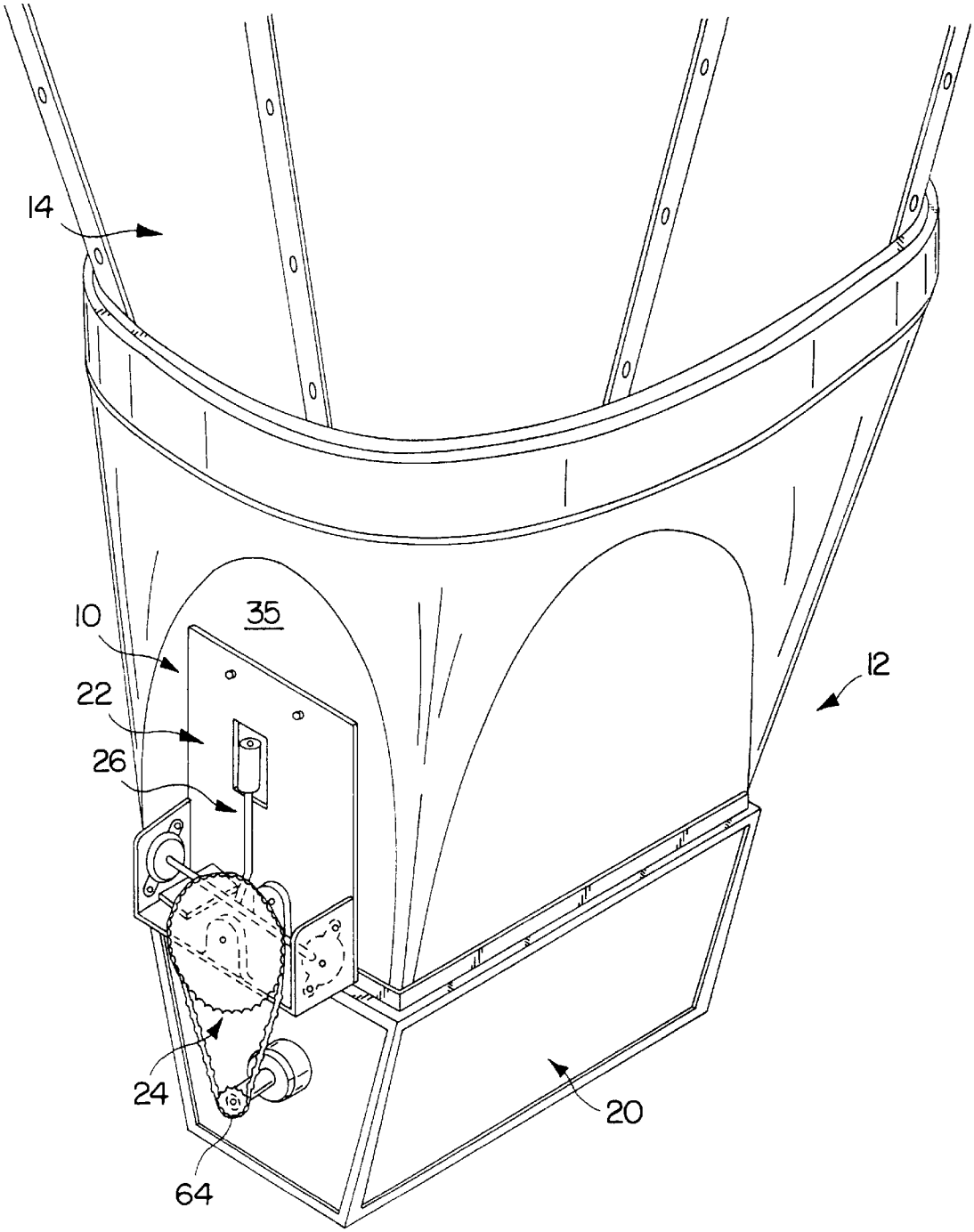
FIG. 4 is a perspective, partly broken away view of the particle flow enhancer without the cover attached to the boot and unloader of the bulk bin, the driven sprocket and part of the U-shaped frame are shown transparent to better show the mechanism.

FIG. 4 shows the particle flow enhancer 10 attached to an exterior surface 35 of the boot 12 of the bulk feed bin 14 with the cover 11 removed. The boot 12 includes a boot unloader 20 which has an upwardly open aperture that is matable with the downwardly open aperture of the boot to place the boot 12 and boot unloader 20 in fluid communication with each other. The auger system 16 picks up the feed dropped into the unloader 20 from the feed bin 14 and the boot 12. The particle flow enhancer 10 includes a frame assembly 22 (to which the cover 11 is mounted), a drive assembly 24 and a striker assembly 26.

Figure 2:
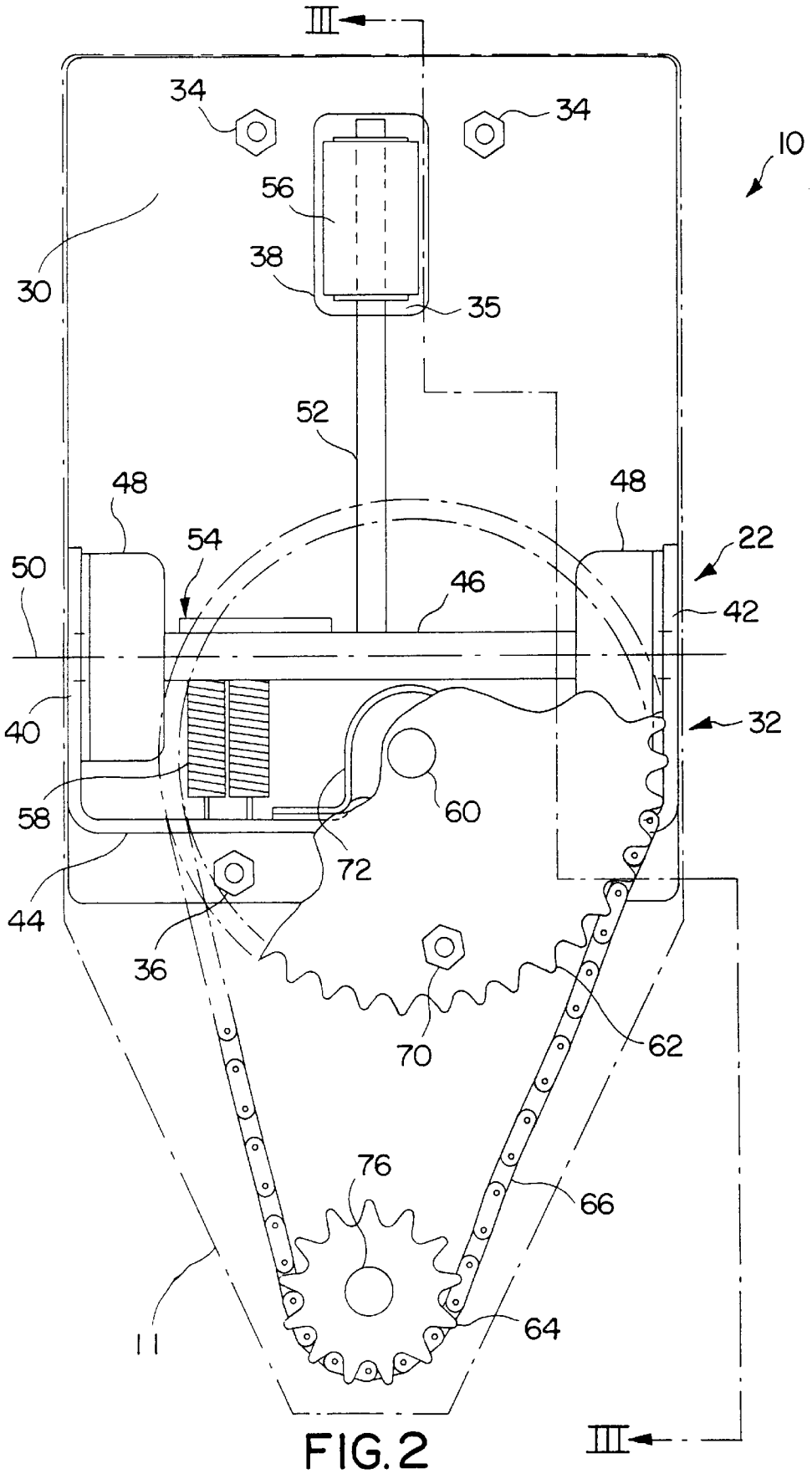
FIG. 2 is a perspective, partly broken away view of a front view of a particle flow enhancer with the cover outlined and the driven sprocket and chain cut away.
Figure 3:
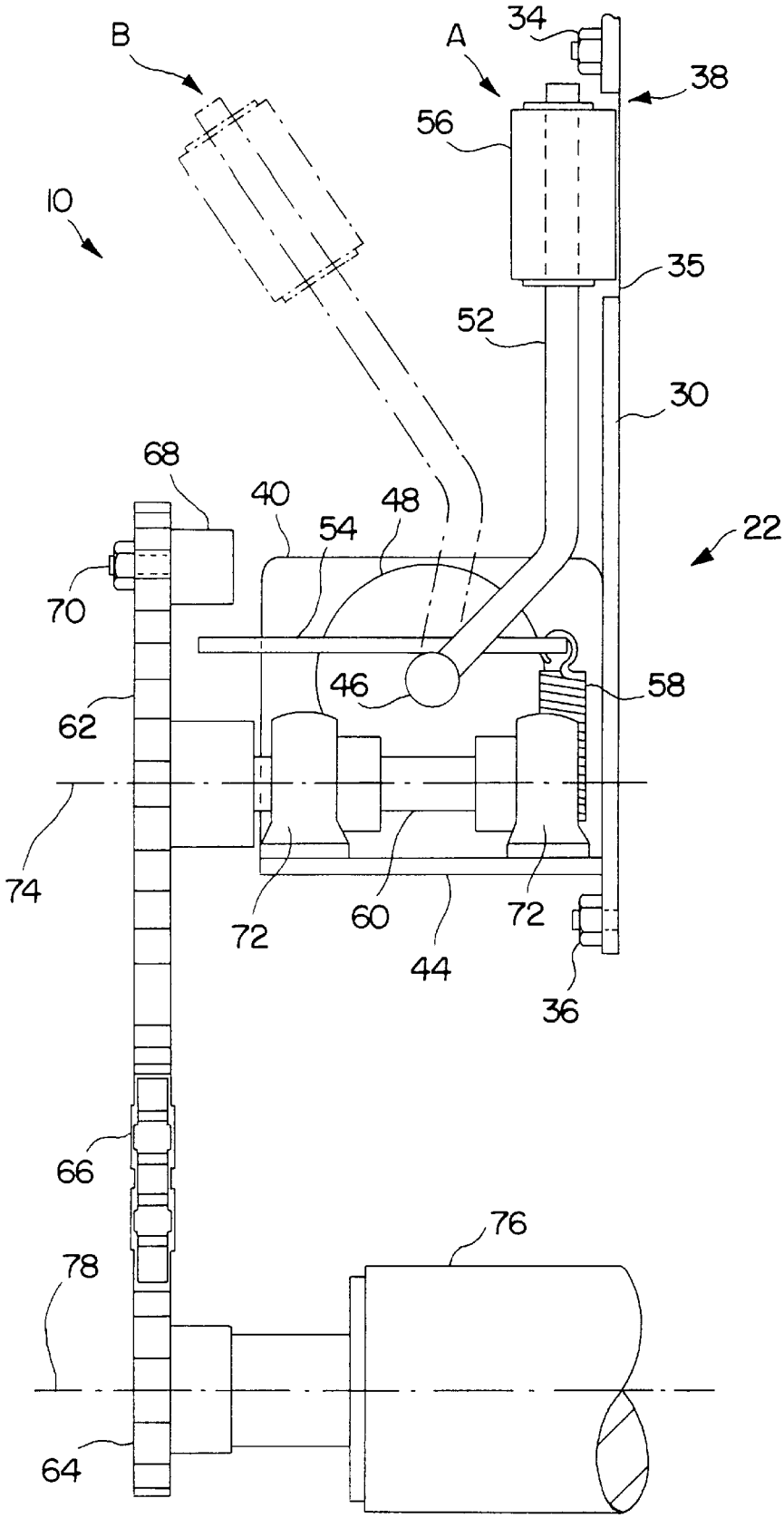
FIG. 3 is a perspective, partly broken away view of a cut-away side view of the particle flow enhancer along the line III—III of FIG. 2 with the striker arm outlined in an extended position.

Referring to FIGS. 2 and 3, the frame assembly 22 of the particle flow enhancer 10 includes a generally rectangular base plate 30 and an attached U-shaped frame 32. The baseplate 30 is attached to the exterior of the boot 12 by upper bolts 34 and lower bolts 36 which pass through apertures (not shown) that extend through the base plate 30. The lower bolts 36 are preferably positioned such that they can be attached using the preexisting holes through which the boot unloader 20 is attached to the boot 12. The baseplate 30 has an opening 38 formed therein for receiving striker head 56. The U-shaped frame 32 has a first end plate 40, a second end plate 42 and a transverse base 44 that extends between the first and second end plates 42, 44. The base plate 30 and U-shaped frame 32 are preferably made of 3/16" thick low carbon steel.

The striker assembly 26 includes an upper shaft 46 to which a striker arm 52 and a trip lever 54 are attached. The upper shaft 46 extends transversely between the first end plate 40 and the second end plate 42 of the U-shaped frame 32. The upper shaft 46 is rotatably coupled to each of the first and second end plates 40, 42 of the U-shaped frame 32 by a bearing 48 which allows the upper shaft 46 to pivot about an upper transverse axis 50. A striker head 56 is attached to the distal end of the striker arm 52 such that the striker head 56 is aligned with and insertable through the opening 38 of the baseplate 30. The striker head 56 is preferably made of Neoprene or a similar material which will not damage the boot 12 from repeated striking. A pair of springs 58 are attached to the trip lever 54 and the base 44 of the U-shaped frame 32 to bias, the upper shaft 46 such that the striker head 56 is biased towards the opening 38 of the baseplate 30 (position A of FIG. 3), to cause the striker head 56 to contact the surface 35 of the boot 12.

The drive assembly 24 includes a lower shaft 60, a driven sprocket 62 having a tripper 68, a driving sprocket 64 and a chain 66 connecting the driving sprocket 64 to the driven sprocket 62. The lower shaft 60 extends perpendicular to the baseplate 30 through a pair of bearings 72 that are mounted on the transverse base 44 of the U-shaped frame 32. The driven sprocket 62 is fixedly attached to the end of the lower shaft 60 furthest from the base plate 30 for rotation with shaft 60. The bearings 72 allow the lower shaft 60 and driven sprocket 62 to rotate together about a lower axis 74. The tripper 68 comprises a generally cylindrical rubber sleeve that is fixedly attached to the driven sprocket 62 by a bolt 70 such that, as the driven sprocket 62 rotates, the tripper 68 orbits about the lower axis 74 of the driven sprocket 62, and, once each orbit, contacts, depresses and releases the trip lever 54 attached to the upper shaft 46. The driving sprocket 64 is attached to a shaft end 76 of the auger system 16 that extends out the back of the unloader 20. During operation of the auger system 16, the shaft end 76 rotates about an auger axis 78 which is substantially parallel to the lower axis 74. The driven sprocket 62 and the driving sprocket 64 are positioned in a common plane and connected by the chain 66. A size 40 chain has been found to work well in this application.

When the auger system 16 is activated, the shaft end 76 of the auger system 16 rotates about the auger axis 78. The rotation of the shaft end 76 turns the driving sprocket 64 which, through the chain 66, drives the driven sprocket 62 to rotate about the lower axis 74. As the driven sprocket 62 rotates, the tripper 68 contacts and depresses the distal end of the trip lever 54 attached to the upper shaft 46 once each rotation of the driven sprocket 62.

Depressing the disial end of the trip lever 54 causes the upper shaft 46 to rotate counterclockwise, from the perspective of FIG. 3, about the upper axis 50. The counterclockwise rotation of the upper shaft 46 extends the springs 58 and pulls the striker arm 52 and striker head 56 away from the baseplate 30; from position A to position B shown in FIG. 3. In doing so, the striker head 56 moves out of contact with the outer surface 35 of the boot 12.

As the driven sprocket 62 continues to rotate, the tripper 68 slides off and releases the trip lever 54 which then allows the extended springs 58 to compressively return to their retracted, relaxed position. The return movement of the springs 58 causes the upper shaft 46 to rotate clockwise, from the perspective of FIG. 3, about the upper axis 50. The clockwise rotation of the upper shaft 46 moves the striker arm 52 and striker head 56 towards the baseplate 30 (from position B to position A shown in FIG. 3) and causes the striker head 56 to strike the exterior surface 35 of the boot 12 through the opening 38 in the baseplate 30.

The shaft end 76, and thus the driving sprocket 64, will normally operate at 358 rotations per minute, which is an industry standard. Preferably, as shown in FIGS. 2–4, the driven sprocket 62 has a larger diameter to decrease the rotation speed of the driven sprocket 62 and the frequency at which the striker head 56 strikes the exterior surface 35 of the boot 12 of the bulk feed bin 14. Preferably, the driven sprocket 62 is sized to rotate at about one-third of the speed of the driving sprocket 64, to achieve a rotation speed of the driven sprocket 62 of approximately 120 rotations per minute which rotation speed has been found to work well. At this speed, the striker head 56 on the striker arm 52 taps the exterior surface 35 of the boot 12 approximately 2 times per second. The tapping will continue while the auger system operates and causes the driving sprocket 64 to rotate.

The particle flow enhancer 10 is designed to mount on industry standard boots 12 as shown in FIG. 4. The lower bolts 36 preferably line up directly with the bin manufacturer's bolts attaching the boot 12 to the unloader 20 as shown in FIG. 4. Holes are drilled into the boot 12 of the bin 14 for attachment of the upper bolts 34.

While a preferred embodiment of the invention has been shown and described, it is understood that changes in structure, materials, sizes, and shapes can be made by those skilled in the art without departing from the spirit and scope of the invention as set forth in the claims attached hereto.

I claim:

1. A particle flow enhancer for a bulk bin flex or rigid auger system having a boot and an unloader, a rotating shaft of the auger system extending through the unloader, said particle flow enhancer, comprising;

a drive system driven by the rotating shaft of the auger system, wherein the drive system includes a driving gear attached to the rotating shaft, a drive axle and a driven gear attached to said drive axle;

a flow enhancer mechanism actuated by said drive system:

a tripper mechanism attached to said driven gear; and chain, wherein said driving gear rotates with the rotating shaft causing said driven gear to rotate, said drive gear and said driving gear are sprockets connected by said chain, and said flow enhancer mechanism includes a striker arm and a trip lever attached to said striker arm, wherein the rotation of said driven gear causes said tripper mechanism to periodically actuate said trip lever, the actuation of said trip lever causing said striker arm to strike said bulk bin auger system.

2. The particle flow enhancer of claim 1, further comprising a striker axle, said striker arm and said trip lever being attached to said striker axle, a biasing force acting on said striker axle to move said striker arm towards said bulk bin auger system; wherein the rotation of said driven gear causes said tripper mechanism to periodically contact said trip lever causing said striker axle to pivot against said biasing force and move said striker arm away from said bulk bin auger system, the continued rotation of said driven gear causing said trip lever to release said trip lever allowing said biasing force to unpivot said striker axle and cause said striker arm to strike said bulk bin auger system.

3. The particle flow enhancer of claim 2, further comprising springs, said springs producing said biasing force acting on said striker axle.

4. A particle flow enhancer for a bulk bin auger system having a rotating shaft, said particle flow enhancer comprising:

a frame having a mounting mechanism for attaching said particle flow enhancer to said bulk bin auger system, a drive axle supported by said frame and driven by the rotation of said rotating shaft; and a striker arm actuated by said drive axle to periodically strike said bulk bin auger system.

5. The particle flow enhancer of claim 4, further comprising a driving gear attached to said rotating shaft and a driven gear attached to said drive axle, wherein said driving gear rotates with said rotating shaft causing said driven gear to rotate.

6. The particle flow enhancer of claim 5, further comprising a chain and wherein said drive gear and said driving gear are sprockets connected by said chain.

7. The particle flow enhancer of claim 5, further comprising a tripper mechanism attached to said driven gear; and a trip lever attached to said striker arm, wherein the rotation of said driven gear causes said tripper mechanism to periodically actuate said trip lever, the actuation of said trip lever causing said striker arm to strike said bulk bin auger system.

8. The particle flow enhancer of claim 7, further comprising a striker axle, said striker arm and said trip lever being attached to said striker axle, a biasing force acting on said striker axle to move said striker arm towards said bulk bin auger system; wherein the rotation of said driven gear causes said tripper mechanism to periodically contact said trip lever causing said striker axle to pivot against said biasing force and move said striker arm away from said bulk bin auger system, the continued rotation of said driven gear causing said trip lever to release said trip lever allowing said biasing force to unpivot said striker axle and cause said striker arm to strike said bulk bin auger system.

9. The particle flow enhancer of claim 8, further comprising springs, said springs producing said biasing force acting on said striker axle.

10. The particle flow enhancer of claim 9, wherein said springs are attached to said trip lever.

11. The particle flow enhancer of claim 4, wherein said striker arm strikes said bulk bin auger system through an opening in said frame.

12. The particle flow enhancer of claim 4, wherein said striker arm includes a striker head at the distal end of said striker arm, said striker head periodically striking said bulk bin auger system.

13. A particle flow enhancer for a bulk bin auger system having a boot and an unloader attached to said boot by an unloader connector mechanism, a rotating shaft extending through said unloader, said particle flow enhancer comprising:

a frame including a baseplate and a mounting mechanism, said mounting mechanism attaching said baseplate to said boot using a portion of said unloader connector mechanism;

a drive axle supported by said frame and driven by the rotation of said rotating shaft; and a striker arm actuated by said drive axle to periodically strike said boot.

14. The particle flow enhancer of claim 13, further comprising a driving gear attached to said rotating shaft and a driven gear attached to said drive axle, wherein said drive gear rotates with said rotating shaft causing said driven gear to rotate.

15. The particle flow enhancer of claim 17, further comprising a tripper mechanism attached to said driven gear; and a trip lever attached to said striker arm, wherein the rotation of said driven gear causes said tripper mechanism to periodically actuate said trip lever, the actuation of said trip lever causing said striker arm to strike said bulk bin auger system.

16. The particle flow enhancer of claim 15, further comprising a striker axle, said striker arm and said trip lever being attached to said striker axle, a biasing force acting on said striker axle to move said striker arm towards said bulk bin auger system; wherein the rotation of said driven gear causes said tripper mechanism to periodically contact said trip lever causing said striker axle to pivot against said biasing force and move said striker arm away from said bulk bin auger system, the continued rotation of said driven gear causing said trip lever to release said trip lever allowing said biasing force to unpivot said striker axle and cause said striker arm to strike said bulk bin auger system.

17. The particle flow enhancer of claim 13, wherein said frame includes a U-shaped frame attached to said baseplate, said U-shaped frame having a base, a first arm and a second arm, said drive axle being attached to said base of said U-shaped frame, and said striker axle extending between said first arm and said second arm of said U-shaped frame.

* * * * *